US010614989B2

(12) United States Patent
Allen et al.

(10) Patent No.: US 10,614,989 B2
(45) Date of Patent: Apr. 7, 2020

(54) CREEP RESISTANT ELECTRON EMITTER MATERIAL AND FABRICATION METHOD

(71) Applicant: General Electric Company, Schenectady, NY (US)

(72) Inventors: Donald R. Allen, Waukesha, WI (US); Gregory A. Steinlage, West Milwaukee, WI (US); Steve Buresh, Niskayuna, NY (US); Don M. Lipkin, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 94 days.

(21) Appl. No.: 15/689,297

(22) Filed: Aug. 29, 2017

(65) Prior Publication Data

US 2019/0066963 A1 Feb. 28, 2019

(51) Int. Cl.

| | |
|---|---|
| ***H01J 35/06*** | (2006.01) |
| ***H01J 35/32*** | (2006.01) |
| ***H01J 35/10*** | (2006.01) |
| ***H01J 3/02*** | (2006.01) |

(52) U.S. Cl.

CPC ..... *H01J 35/06* (2013.01); *H01J 3/027* (2013.01); *H01J 35/064* (2019.05); *H01J 35/101* (2013.01); *H01J 35/32* (2013.01)

(58) Field of Classification Search

CPC ..... H01J 35/06; H01J 35/101; H01J 35/32

See application file for complete search history.

(56) References Cited

U.S. PATENT DOCUMENTS

| | | | | |
|---|---|---|---|---|
| 5,489,348 | A * | 2/1996 | Knudsen | C21D 9/525 148/595 |
| 5,515,413 | A * | 5/1996 | Knudsen | H01J 35/06 378/136 |
| 5,996,385 | A | 12/1999 | Kecskes | |
| 6,419,758 | B1 * | 7/2002 | Bewlay | C22C 1/045 148/273 |
| 7,545,089 | B1 | 6/2009 | Falce et al. | |
| 8,831,178 | B2 | 9/2014 | Lemaitre | |

(Continued)

OTHER PUBLICATIONS

Ives et al., "High Current Density—Long Life Cathodes for High Frequency Applications", Vacuum Electronics Conference (VEC), 2010 IEEE International, 2 pages.

(Continued)

*Primary Examiner* — Mark R Gaworecki

(74) *Attorney, Agent, or Firm* — Boyle Fredrickson, S.C.

(57) ABSTRACT

In the present invention, a flat emitter is formed by the formation of emitter material wires into a unitary non-porous flat emitter structure. The wires are formed with increased yield and tensile strength as a result of the manner of the formation of the emitter material or metal into the wires that is transferred to the flat emitter. To form the flat emitter, the wires are encapsulated and subjected to sufficient temperatures and pressure in a hot isostatic pressing treatment/process to increase the density of the wires into a solid sheet without the presence of voids or pores in the sheet. In forming the emitter sheet in this manner, the strength properties from the wires are retained within the sheet to provide the emitter with increased creep resistance and a consequently longer useful life in the x-ray tube.

20 Claims, 5 Drawing Sheets

(56) References Cited

U.S. PATENT DOCUMENTS

| | | | | |
|---|---|---|---|---|
| 2005/0226385 | A1* | 10/2005 | Simpson | H01J 35/101 378/132 |
| 2008/0101541 | A1* | 5/2008 | Steinlage | H01J 35/108 378/143 |
| 2009/0284124 | A1* | 11/2009 | Kutschera | H01J 1/14 313/346 DC |
| 2010/0092699 | A1* | 4/2010 | Steinlage | H01J 35/08 427/591 |
| 2018/0350549 | A1* | 12/2018 | Lampe | H01J 35/06 |

OTHER PUBLICATIONS

Sheldon Cytron, "Recent Advances in High Density Tungsten Composite Processing", Technical Report ARAED-TR-93007, U.S. Army Armament Research, Development and Engineering Center, Picatinny Arsenal, New Jersey, Oct. 1993, 21 pages.

* cited by examiner

CREEP RESISTANT ELECTRON EMITTER MATERIAL AND FABRICATION METHOD

BACKGROUND OF INVENTION

The invention relates generally to emitters for x-ray imaging systems and more particularly to improvements to the structures of emitters of this type.

Presently available medical x-ray tubes typically include a cathode assembly having an emitter and a cup. The cathode assembly is oriented to face an x-ray tube anode, or target, which is typically a annular metal or composite structure. The space between the cathode and anode is evacuated.

X-ray tubes typically include an electron source, such as a cathode, that releases electrons at high acceleration. Some of the released electrons may impact a target anode. The collision of the electrons with the target anode produces X-rays, which may be used in a variety of medical devices such as computed tomography (CT) imaging systems, X-ray scanners, and so forth. In thermionic cathode systems, a filament is included that may be induced to release electrons through the thermionic effect, i.e. in response to being heated. However, the distance between the cathode and the anode must be kept short so as to allow for proper electron bombardment. Further, thermionic X-ray cathodes typically emit electrons throughout the entirety of the surface of the emitter. Accordingly, it is very difficult to focus all electrons into a small focal spot.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The data acquisition system then reads the signals received in the detector, and the system then translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes typically include a rotating anode structure for the purpose of distributing the heat generated at a focal spot. An x-ray tube cathode provides an electron beam from an emitter that is accelerated using a high voltage applied across a cathode-to-anode vacuum gap to produce x-rays upon impact with the anode.

Typically, the cathode includes one or more cylindrically wound filaments positioned within a cup for emitting electrons as a beam to create a high-power large focal spot or a high-resolution small focal spot, as examples. Imaging applications may be designed that include selecting either a small or a large focal spot having a particular shape, depending on the application.

In these prior art x-ray tubes, the wire(s) forming the filaments are formed of drawn wire formed into coiled shape to function as the emitter. The formation of the wire in a suitable drawing process provides sufficient deformation processing to the material in order to result in a creep resistance imparted through subsequent annealing of the material. This processing, in addition to other manners of strengthening the emitter material, such as carbide-, oxide-, and/or void-strengthening the emitter material, allows the wire to have significant resistance to creep as a result of the high operating temperatures for the emitter.

Conventional cylindrically wound filaments, however, emit electrons in a complex pattern that is highly dependent on the circumferential position from which they emit toward the anode. Due to the complex electron emission pattern from a cylindrical filament or wire, focal spots resulting therefrom can have non-uniform profiles that are highly sensitive to the placement of the filament within the cup. As such, cylindrically wound filament-based cathodes are required to be manufactured having their filament positioned with very tight tolerances in order to meet the exacting focal spot requirements in an x-ray tube.

In order to generate a more uniform profile of electrons toward the anode to obtain a more uniform focal spot, cathodes having an approximately flat emitter surface have been developed, a flat surface emitter (or a 'flat emitter') may be positioned within the cathode cup with the flat surface positioned orthogonal to the anode, such as that disclosed in U.S. Pat. No. 8,831,178, incorporated herein by reference in its entirety. In the '178 patent a flat emitter with a rectangular emission area is formed with a very thin material having electrodes attached thereto, which can be significantly less costly to manufacture compared to conventionally wound (cylindrical or non-cylindrical) filaments and may have a relaxed placement tolerance when compared to a conventionally wound filament.

In addition, recent developments in diagnostic x-ray tubes made it desirable to provide high emission at reduced tube voltages. For example in vascular x-ray tubes it is desirable to reduce tube voltages to 60 kV from the typical lower limit of 80 kV while ideally maintaining the power delivered to the target. For large focal spots, emission currents between 1000 mA and 1500 mA at 60 kV are desirable. For small focal spots, especially in fluoroscopic mode, emission currents up to 400 mA are desirable.

These current emitters are formed from rolled sheets of the emissive or emitter material. These sheets are formed from the same metals and/or materials utilized for the wound emitters, but are rolled into flat sheets instead of being drawn or worked into wires. These flat sheets are then cut into emitters having the desired shapes and configurations for use in x-ray tubes for more precise direction of the electrons from the emitters onto the anode/target for x-ray generation.

In rolling the material into the sheets, the amount of deformation created in the sheets is less than that created in the formation of the wires. As a result, the sheets formed of the emitter material do not have the same high temperature property benefit as found in the wound emitters. As such, under the high operating temperatures for the flat emitters, these emitters become subject to creep at lower accumulated operational times, thereby decreasing the life span of the flat emitter.

One prior art attempt to overcome this issue with flat emitters is disclosed in Falce et al. U.S. Pat. No. 7,545,089 entitled Sintered Wire Cathode, the entirety of which is expressly incorporated herein by reference for all purposes. In this reference, wires formed an emitter metal, i.e., tungsten, are wound about a bobbin and sintered in order to form the wires into a porous cathode structure including a number of desired uniform pores formed within the cathode structure as a result of the wire diameter and sintering parameters utilized.

However, the presence of the voids in the resulting porous cathode structure significantly limits the effectiveness of the cathode as a thermionic electron emitter including voids or pores in the emitter structure is detrimental to the desired emission of electrons from the emitter/cathode as well as the detrimental structural integrity impacts.

Accordingly, it is desirable to provide an emitter for an x-ray tube cathode having a flat, non-porous structure that includes yield strength, tensile strength and creep-resistance properties similar to that of wire formed or wound emitters.

BRIEF DESCRIPTION OF THE INVENTION

There is a need or desire for a flat emitter that has increased creep-resistance properties in order to improve the useful life of the flat emitter from that of flat, rolled emitters. The above-mentioned drawbacks and needs are addressed by the embodiments described herein in the following description.

According to one exemplary aspect of the invention, a flat emitter is formed by the formation of emitter material preforms formed of the emitter material, such as wires or any other the preforms that possess sufficient work history and performance attributes to achieve the creep resistance, e.g., doping and/or ion implantation into foils, into a unitary non-porous flat emitter structure. The preforms, e.g., wires, are formed with increased thermomechanical deformation properties, including but not limited to creep resistance, yield and tensile strength as a result of the manner of the formation of the emitter material or metal into the preform(s) that is transferred to the flat emitter formed from the preform material. To form the flat emitter, the preform(s) are encapsulated and subjected to sufficient a process that applies sufficient temperatures and pressure to increase the density of the preform into a solid component, rod, sheet plate, etc. without the presence of voids or pores in the resulting component. In forming the emitter in this manner, pressures applied in conjunction with the high temperatures, the beneficial creep resistance and other high temperature microstructure/morphology and thermomechanical deformation properties from the preform(s) are retained within the resulting component to provide the emitter with increased creep resistance and a consequently longer useful life in the x-ray tube.

According to another exemplary embodiment of the invention, an emitter with enhanced creep-resistant properties for an x-ray tube includes an assembly of wires having a defined creep resistance, each wire including at least one component formed of an electron emitter material, wherein the emitter does not include a work function lowering material.

According to another aspect of the invention, a method for forming an emitter with enhanced creep-resistant properties for an x-ray tube includes the steps of: providing a preform having a defined creep resistance, the preform including at least one component formed of an electron emitter material and subjecting the assembly of wires to a consolidation process to form an emitter, According to a further aspect of the invention, a method for forming an emitter for an x-ray tube having enhanced creep-resistant properties includes the steps of providing a preform having a desired creep resistance, the preform including at least one component formed of an electron emitter material, subjecting the preform to a consolidation process to form a rod, slicing the rod to form a number of sheets; and cutting each of the number of sheets to form the emitter.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The drawings illustrate the best mode presently contemplated of carrying out the disclosure. In the drawings

DETAILED DESCRIPTION OF THE DRAWINGS

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
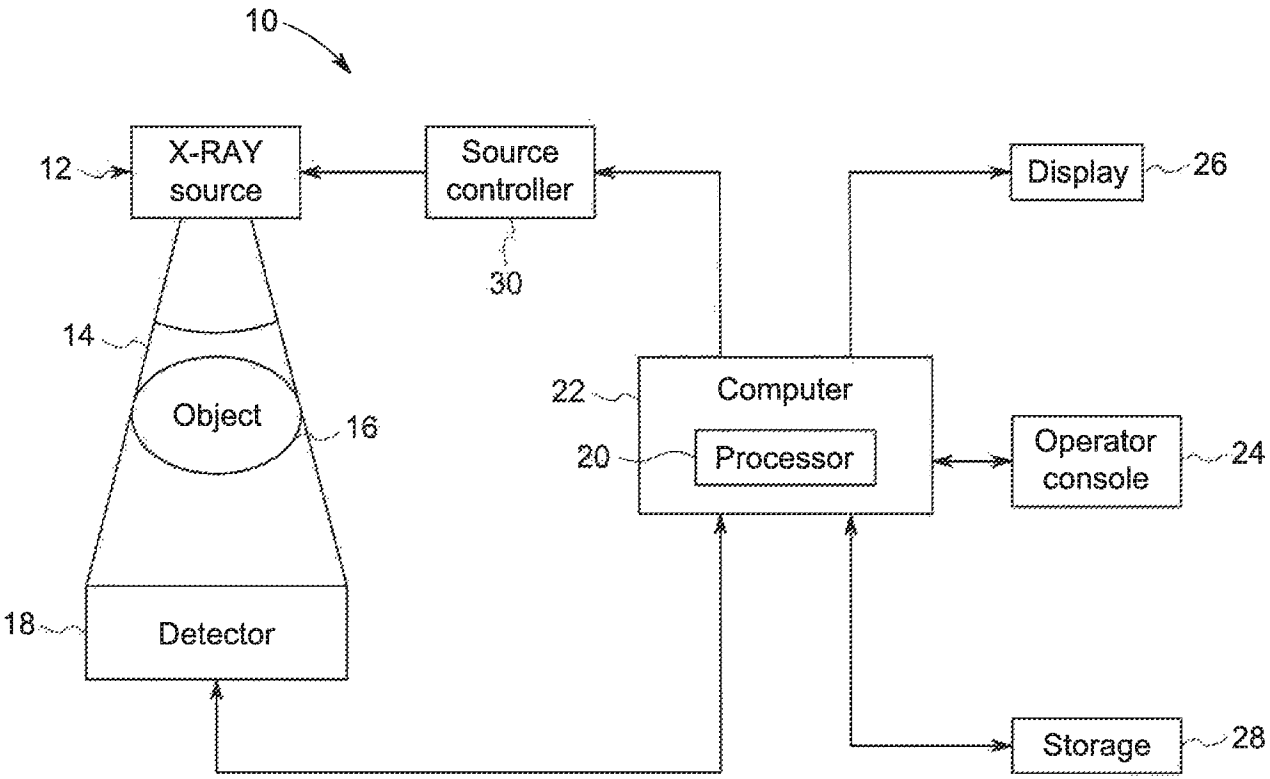
FIG. 1 is a block diagram of an imaging system according to an exemplary embodiment of the invention.

FIG. 1 is a block diagram of an embodiment of an imaging system 10 designed both to acquire original image data and to process the image data for display and/or analysis in accordance with embodiments of the invention. It will be appreciated by those skilled in the art that embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from embodiments of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 2:
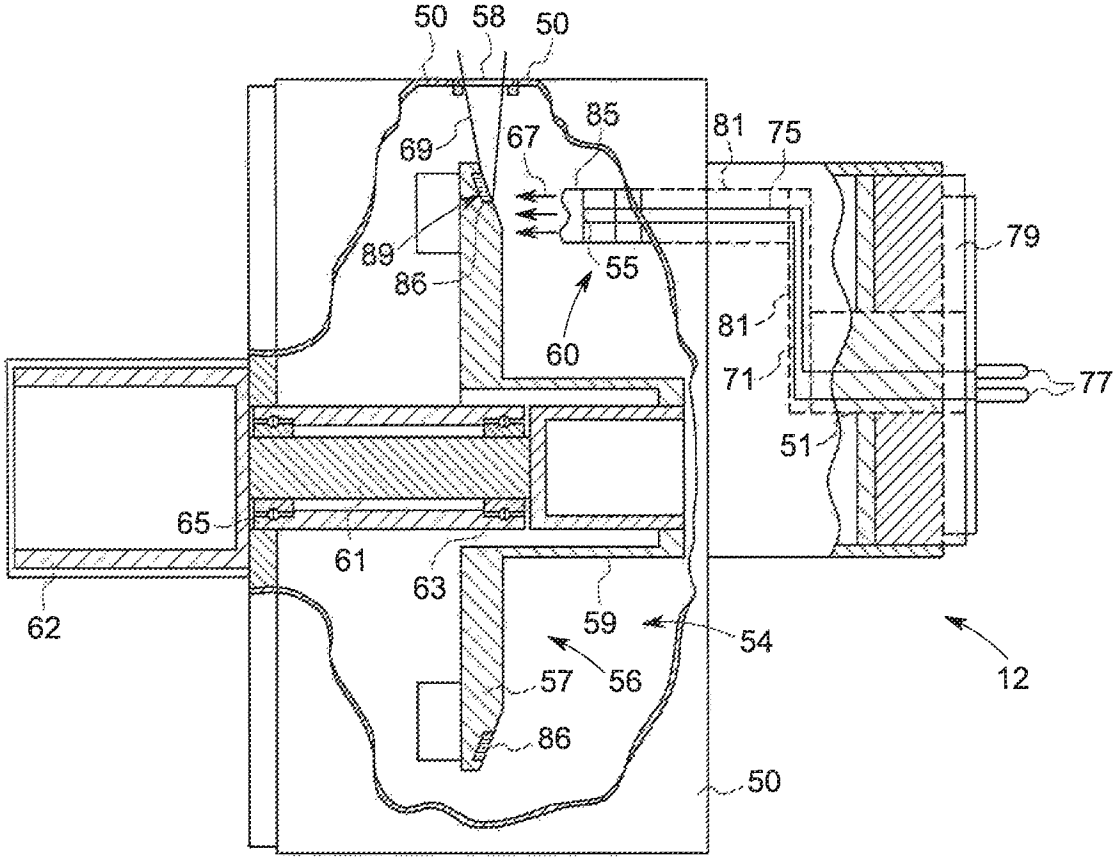
FIG. 2 is a cross-sectional view of an x-ray tube according to an exemplary embodiment of the invention.

FIG. 2 illustrates a cross-sectional view of an x-ray tube 12 incorporating embodiments of the invention. X-ray tube 12 includes a frame 50 that encloses a vacuum region 54, and an anode 56 and a cathode assembly 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 56 is attached to a shaft 61 supported by a front bearing 63 and a rear bearing 65. Shaft 61 is attached to a rotor 62. Cathode assembly 60 includes a flat emitter or filament 55 formed of any suitable emitter material and coupled to a current supply lead 71 and a current return 75 that each pass through a center post 51. In operation, electrical current is carried to flat emitter 55 via the current supply lead 71 and from flat emitter 55 via the current return 75 which are electrically connected to source controller 30 and controlled by computer 22 of system 10 in FIG. 2.

Feedthrus 77 pass through an insulator 79 and are electrically connected to electrical leads 71 and 75. X-ray tube 12 includes a window 58 typically made of a low atomic number metal, such as beryllium, to allow passage of x-rays therethrough with minimum attenuation. Cathode assembly 60 includes a support arm 81 that supports cathode cup 73, flat emitter 55, as well as other components thereof. Support arm 81 also provides a passage for leads 71 and 75.

In operation, target 56 is spun via a stator (not shown) external to rotor 62. An electric current is applied to flat emitter 55 via feedthrus 77 to heat emitter 55 and emit electrons 67 therefrom. A high-voltage electric potential is applied between anode 56 and cathode 60, and the difference therebetween accelerates the emitted electrons 67 from cathode 60 to anode 56. Electrons 67 impinge target 57 at target track 86 and x-rays 69 emit therefrom at a focal spot 89 and pass through window 58.

Figure 3A:
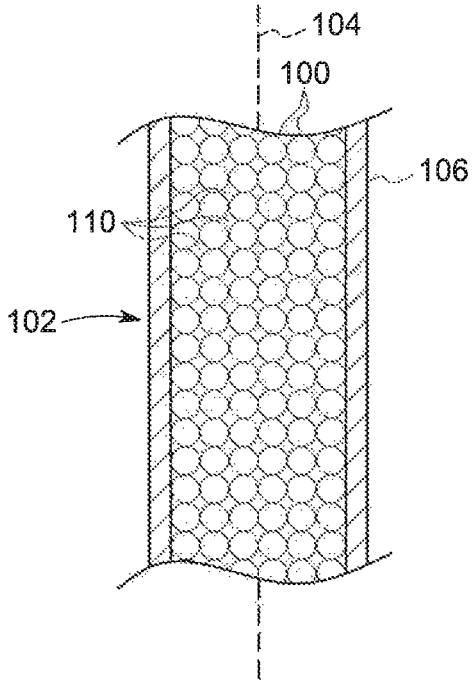
FIGS. 3A-3D are schematic views of different cross-sectional configurations for an assembly of wires prior to formation into a rod according to an aspect of the present invention.
Figure 3B:
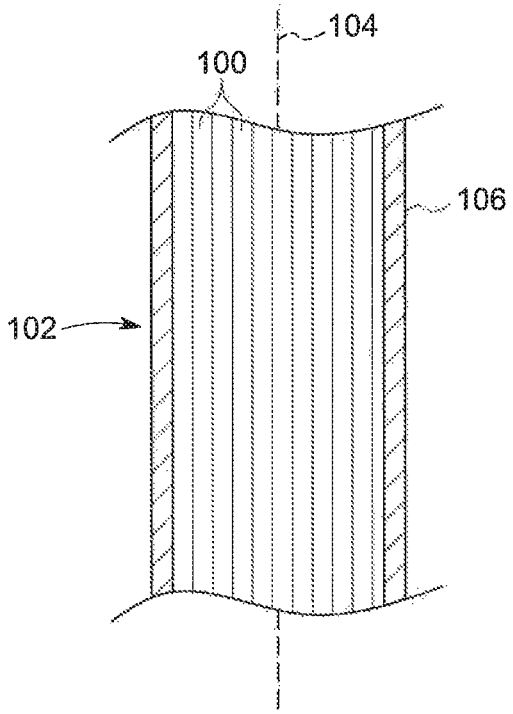
Figure 3C:
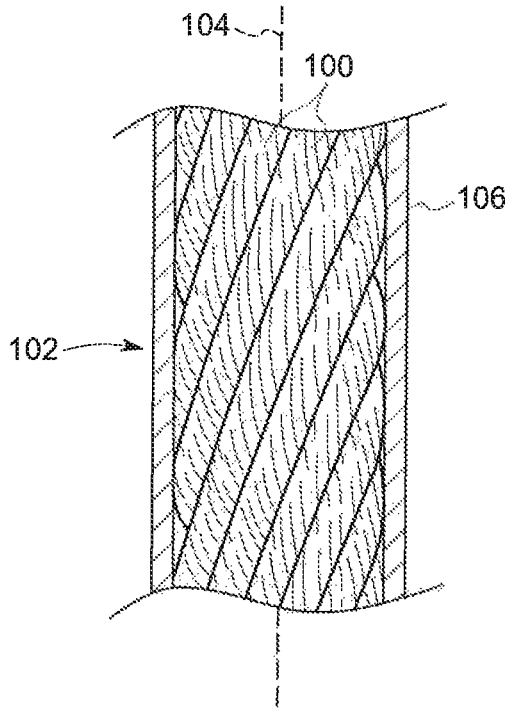
Figure 3D:
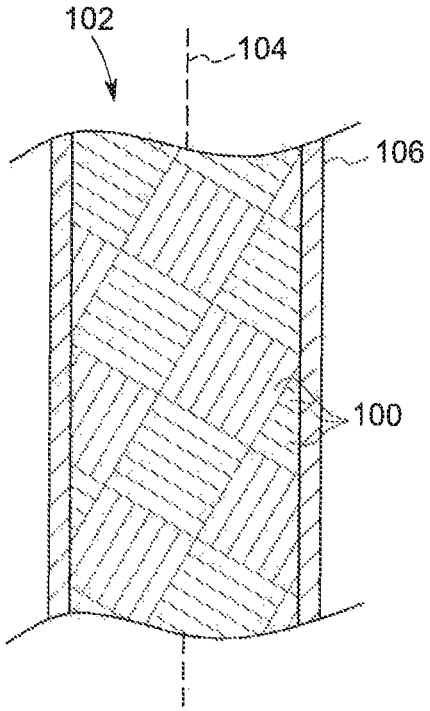

To form the emitter 55, looking at FIGS. 3A-3D, initially a preform A formed of an electron emitter material, such as tungsten or tantalum, is provided which in the illustrated embodiment includes a number of wires 100 formed into an assembly 102. The particular form, shape, work history and/or enhancement of the preform A can be selected as desired, and in the illustrated embodiment the arrangement or texture of the wires 100 within the assembly 102 can be selected as desired, and can include wires 100 running perpendicular to a central axis 104 of the assembly 102 (FIG. 3A), parallel to the central axis 104 (FIG. 3B), in a rope or serpentine pattern relative to the central axis 104 (FIG. 3C), or at one or more angles with respect to the central axis 104 (FIG. 3D). The preform A e.g., wire 100 or assembly 102, and/or elements thereof, such as the wires 100, can additionally have any desired configuration and/or cross-section, such as round, square, rectangular, hexagonal, octagonal, etc. The wires 100 are held in the desired configuration within the assembly 102 in one exemplary embodiment by a suitable encapsulant or encapsulating material 106 such as tungsten, tantalum, niobium, hafnium, rhenium or any other material that is metallurgically compatible with the preform A and sufficiently malleable at the forming temperatures and pressures positioned around the wires 100 forming the assembly 102. However, in alternative embodiments the assembly 102 can be formed without the encapsulating material 106. Further, depending on the desired shape for the emitter 55, the assembly 102 can be formed with a desired cross-section corresponding to the shape of the emitter 55 to be formed. In the illustrated exemplary embodiments, the assembly 102 is formed with a circular cross-section, though rectangular cross-sections and cross-sections of other shapes are also contemplated as being within the scope of this disclosure.

Figure 4:
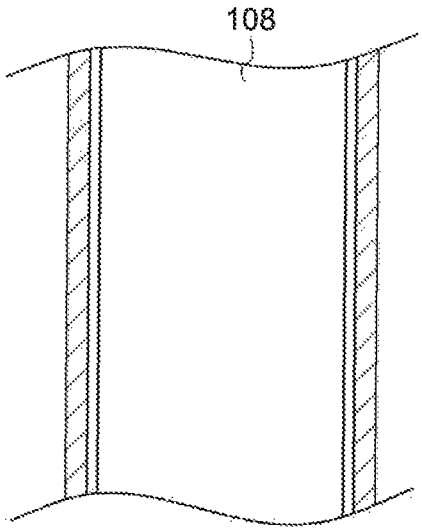
FIG. 4 is a schematic view of the cross-section of the assembly of wires of FIG. 3A after formation into the rod according to an aspect of the present invention.

The assembly 102 is the positioned within a suitable containment vessel (not shown) and subjected to selected temperatures and pressures in order to form a component, such as a rod 108 (FIG. 4) having any desired shape or configuration of the material constituting the wires 100 that has approximately the overall length and width of the assembly 102 of the wires 100. Due to the formation of the rod 108 from the wires 100 in the process through the application of sufficient temperature and pressure, the rod 108 eliminates internal voids and microporosity within the material forming the rod 108 through a combination of plastic deformation, creep, and diffusion bonding of the material. The consolidation method or process utilized to create the component or rod 108 from the preform A/assembly of wires 102 can be any suitable process or method for mechanical consolidation and/or forming including but not limited to hot rolling, hot extrusion, hot swaging, hot pressing, spark plasma sintering (SPS), hot forging, hot explosion bonding and hot isostatic pressing (HIP) among others.

In one exemplary embodiment of the invention using the hot isostatic pressing treatment or process, within the containment vessel the assembly 102 is subjected to temperatures between 600° C.-3000° C., and in other embodiments between 1000° C.-2500° C., and pressures sufficient to achieve consolidation of the wires 100 in the assembly 102, such as greater than approx. 5 ksi for HIP or flow stress above 50 MPa, while simultaneously having the pressure maintained in isostatic manner within the containment vessel against the entire exterior surface of the assembly 102. The pressures exerted against the assembly 102 can be generated by introducing a gas, such as an inert gas, into the containment chamber until the desired pressure within the chamber is reached. In this manner the desired pressure is exerted on all surfaces of the assembly 102 equally to achieve the desired effect in conjunction with the application of the desired temperature to the assembly 102. After completion of the process, the encapsulating material 106, which forms a skin around the assembly 102 and the resulting rod 108, can be removed for further processing of the rod 108.

In this manner, the hot isostatic pressing process alters the wires 100 within the assembly 102 by increasing the density of the rod 108 formed from the wires 100, thereby compressing the wires 100 into a solid component, e.g., the rod 108, while additionally eliminating the voids 110 (FIG. 3A) initially present between the wires 100 in the assembly 102. The hot isostatic pressing also enables the wires 100 to retain the enhanced high temperature thermomechanical properties and other properties obtained as a result of the working of the material in initially forming the wires 100. As such, the rod 108 includes the creep-resistance properties present in the wires 100 when formed in this manner, which in certain exemplary embodiment can be equivalent thermomechanical properties to the wire 100/preform A, e.g., the creep resistance, of the wires 100/preform A. Also, a rod 108 formed from the assembly 102 of wires 100 in the hot isostatic pressing process has porosity equivalent or approaching that of a conventionally formed flat sheet for use an emitter 55, in addition to the increased mechanical properties for the rod 108. Further, in various exemplary embodiments, the hot isostatic pressing process forms the rod 108 enables the rod 108 to have the increased creep-resistant properties without the need for any work function lowering material placed on the rod 108 or on any individual wires 100 utilized to form the rod 108.

Figure 5:
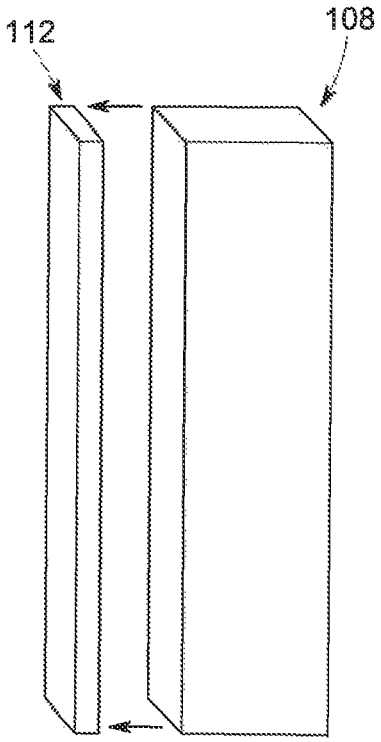
FIG. 5 is a schematic view of the rod of FIG. 4 being sliced into the individual sheets utilized to form a flat emitter according to an aspect of the present invention.

After formation of the rod 108 in the hot isostatic pressing treatment or other suitable process, the rod 108 can be sliced into sheets 112 that are ultimately utilized to form the emitters 55. As shown in FIG. 5, the rod 108 is separated into sheets 112 of the desired thickness using any suitable process, such as mechanical cutting or electrical discharge machining (EDM). The emitters 55 can then be cut directly from the sheets 112 in any suitable manner, such as by EDM or laser. While the exemplary embodiment of FIG. 5 shows the slices 112 being formed by cutting the rod 108 length wise along the length of the rod 108, thereby maintaining the orientation of the sheets 112 with the original orientation of the wires 100, and the consequent thermomechanical properties of the wires 100. However, other orientations of the slices 112 relative to the rod 108 or other component are contemplated as being within the scope of the invention.

In alternative embodiments of the processes used to form the sheets 112 from the preform A, such as the hot isostatic pressing process, eliminating gas between the elements of the preform A, e.g., the wires 100 in the assembly 102, enables consolidation and elimination of voids between the elements/wires 100. Further, the materials forming the wires 100 can be strengthened during their initial formation in order to enable the enhancements to the strength and/or thermomechanical properties of the wires 100 to be carried through to the sheet 112 formed from the wires 100 in the formation process. In some exemplary embodiments, these enhancements include, but are not limited to, oxide doping such as potassium-doped, alkali-doped, or dispersion of the refractory metal(s) forming the wires 100, such as lanthanum oxide dispersion, and/or carbide doping or dispersion of the refractory metal(s) forming the wires 100, such as hafnium carbide or zirconium carbide dispersion. In any embodiment of the assembly 102, the individual composite microstructure of the wires 100 forming the assembly 102 is retained within as the microstructure for the sheet 112 formed from the assembly 102. This provides significant benefits to emitters 55 that are formed from the sheet 112, as the tensile strength and creep resistance of potassium doped tungsten wires is much higher at elevated temperatures than that of a flat sheet of potassium doped tungsten at the same temperatures. In one exemplary embodiment of the sheet 112, as doped tungsten wire is known to have dramatically better creep properties than doped tungsten sheet, due to better distribution and reduced size of the potassium bubbles, a wire 100 formed of that material can be drawn down to very small sizes, giving an even better distribution and size reduction of bubbles within the wire 100. This bubble distribution would be retained in the rod 108 and/or sheet 112 formed of the wires 100 in the formation process, such that a sheet 112 formed from the wires 100 in the process of the invention would have similar density to and better creep properties than a prior art rolled sheet.

Further, in another exemplary embodiment, after the formation of the rod 108 and/or the sheet 112 from the wires 100 in the selected process, the rod 108 and/or the sheet 112 can be subjected to additional mechanical working, such as extrusion, rolling and/or swaging, among other suitable processes. This added work to the rod 108 and/or the sheet 112 further increases the density of the sheet 112, and can further enhance the deformation of the microstructure of the material forming the rod 108 and/or the sheet 112, thereby further increasing the creep resistance of the material forming the rod 108 and/or the sheet 112.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for forming a flat electron emitter with enhanced creep-resistant properties for an x-ray tube comprising the steps of:

providing a preform having a defined creep resistance, the preform including at least one component formed of an electron emitter material; and subjecting the preform to a consolidation process to form a non-porous flat electron emitter.

2. The method of claim 1, wherein the preform comprises a number of wires and further comprising the step of configuring the number of wires into an assembly.

3. The method of claim 2, wherein the step of configuring the number of wires into an assembly comprises encapsulating the number of wires.

4. The method of claim 3, wherein the step of encapsulating the number of wires comprises encapsulating the number of wires to form the assembly with a desired cross-sectional shape.

5. The method of claim 2, wherein the step of configuring the number of wires into an assembly comprises orienting the number of wires relative to a central axis of the assembly.

6. The method of claim 1, wherein a creep resistance of the flat electron emitter is approximately equal to the creep resistance of the number of wires.

7. The method of claim 1 wherein the consolidation process is selected from the group consisting of hot rolling, hot swaging, hot pressing, hot forging, hot explosion binding and hot isostatic pressing.

8. The method of claim 7, wherein the step of subjecting the assembly to a consolidation process comprises:

placing the assembly within a containment chamber; and subjecting the assembly to a hot isostatic pressing process at a suitable temperature and pressure.

9. The method of claim 8, wherein the temperature is selected from within a range of between 600° C. and 3000° C.

10. The method of claim 8, wherein the pressure is selected from a within a range of above 5 ksi.

11. The method of claim 1, wherein the step of subjecting the assembly to the consolidation process comprises:

forming a rod in the consolidation process; and slicing the rod to form the flat electron emitter.

12. The method of claim 11, further comprising the step of subjecting the rod to additional mechanical working prior to slicing the rod to form the flat electron emitter.

13. A method for forming an emitter with enhanced creep-resistant properties for an x-ray tube comprising the steps of:

providing a preform having a defined creep resistance, the preform including at least one component formed of an electron emitter material; and subjecting the preform to a consolidation process to form an emitter, wherein the step of subjecting the reform to the consolidation process comprises;

forming a rod in the consolidation process; and slicing the rod to form the emitter, and wherein the step of slicing the rod to form the emitter comprises:

slicing the rod to form a number of sheets; and cutting each of the number of sheets to form the emitter.

14. The method of claim 13, further comprising the step of subjecting each sheet to additional mechanical working prior to cutting each sheet to form the emitter.

15. A method for forming an emitter for an x-ray tube having enhanced creep-resistant properties comprising the steps of:

providing a preform having a desired creep resistance, the preform including at least one component formed of an electron emitter material;

subjecting the preform to a consolidation process to form a rod;

slicing the rod to form a number of sheets; and cutting each of the number of sheets to form the emitter.

16. The method of claim 15, wherein the preform comprises a number of wires and further comprising the step of configuring the number of wires into an assembly of wires with a desired cross-sectional shape.

17. The method of claim 16, wherein the step of configuring the number of wires into an assembly comprises:

orienting the number of wires relative to a central axis of the assembly; and encapsulating the number of wires to form the assembly with a desired cross-sectional shape.

18. An emitter with enhanced creep-resistant properties for an x-ray tube comprising:

an assembly of wires having a defined creep-resistance, each wire including at least one component formed of an electron emitter material;

wherein the emitter does not include a work function lowering material or pores.

19. The emitter of claim 18, wherein the emitter has a creep resistance approximately equal to the creep resistance of the wires in the assembly.

20. The emitter of claim 18 wherein the emitter has a creep resistance higher than an emitter formed from a rolled sheet of identical material.

* * * * *